US007388361B2

(12) United States Patent
Hsieh et al.

(10) Patent No.: US 7,388,361 B2
(45) Date of Patent: Jun. 17, 2008

(54) MAINBOARD AND POWER CONTROL DEVICE THEREOF

(75) Inventors: Henry Hsieh, Shindian (TW); Paul Su, Shindian (TW)

(73) Assignee: Via Technologies, Inc., Taipei (TW)

( * ) Notice: Subject to any disclaimer, the term of this patent is extended or adjusted under 35 U.S.C. 154(b) by 335 days.

(21) Appl. No.: 11/099,567

(22) Filed: Apr. 6, 2005

(65) Prior Publication Data

US 2006/0125452 A1 Jun. 15, 2006

(30) Foreign Application Priority Data

Dec. 13, 2004 (TW) ..... 93138527 A

(51) Int. Cl.
*G05F 1/40* (2006.01)

(52) U.S. Cl. ..... 323/285; 323/299; 363/89

(58) Field of Classification Search ..... 323/222, 323/210, 285, 287, 282, 299; 363/80, 81, 363/89; 361/56, 91, 111
See application file for complete search history.

(56) References Cited

U.S. PATENT DOCUMENTS

| | | | | |
|---|---|---|---|---|
| 4,709,322 A | 11/1987 | Mirow | ..... | 363/86 |
| 5,255,146 A * | 10/1993 | Miller | ..... | 361/56 |
| 5,612,609 A * | 3/1997 | Choi | ..... | 323/210 |
| 7,015,732 B1 * | 3/2006 | Holloway et al. | ..... | 327/143 |

* cited by examiner

*Primary Examiner*—Rajnikant B Patel
(74) *Attorney, Agent, or Firm*—Birch, Stewart, Kolasch & Birch, LLP

(57) ABSTRACT

A power control device includes a comparison unit, a control unit and a switch unit. The comparison unit electrically connects to a first power rail and a second power rail, respectively, and generates a comparing signal according to a reference signal, a first voltage level and a second voltage level. The control unit electrically connects to the comparison unit for receiving the comparing signal. Then, the control unit generates a control signal based on the comparing signal. The switch unit electrically connects to the control unit, and is on/off based on the control signal, so as to connect/disconnect the first power rail and the second power rail.

20 Claims, 4 Drawing Sheets

MAINBOARD AND POWER CONTROL DEVICE THEREOF

BACKGROUND OF THE INVENTION

1. Field of Invention

The invention relates to a mainboard and a power control device and, in particular, to a mainboard, which includes a chip having a plurality of input power sources, and a power control device thereof.

2. Related Art

Accompanying with the progress of technologies, various kinds of electrical information devices, such as computers, mobile phones, network servers, etc., must employ several chips to enable themselves for matching the modern information life. Thus, it is one of the most important researches in the information industry to make the chips work normally.

In general, the chips are installed on a circuit board, such as a printed circuit board. To achieve the objectives of increasing the integration of chips, decreasing the power consumption, and enhancing the operation speed, the core circuits of the chips usually have the lower bias voltage and electrical signals with the lower voltage level. However, the chips also include some other circuits, such as the I/O buffer, which need higher voltage levels. For example, the mainboard usually includes a south bridge chip, which includes a plurality of digital logics. The digital logics may be driven by the voltage level of 3.3 volts or 2.5 volts. Accordingly, the mainboard must configure two power rails, including, for example, a 3.3-Volt power rail and a 2.5-Volt power rail. The power rails connect to the south bridge chip for providing the voltages of different voltage levels, which allow the south chip operating normally.

Ideally, the two power rails reach the regulating voltage states at the same time, so as to drive the digital logics of the south bridge chip simultaneously. However, the two power rails usually can not reach the regulating voltage states (2.5 volts and 3.3 volts) at the same time. If the time delays that the two power rails reach the regulating voltage states are too long, the chip may operate abnormally.

Therefore, this invention provides a mainboard and a power control device thereof, which can shorten the time delays that the two power rails reach the regulating voltage states.

SUMMARY OF THE INVENTION

In view of the foregoing, the invention is to provide a mainboard and a power control device thereof, which can shorten the time delays that the two power rails reach the regulating voltage states.

To achieve the above, a power control device of the invention is cooperated with a first power rail and a second power rail. The first power rail and the second power rail are respectively coupled to a chip for providing a first voltage level to the chip through the first power rail and a second voltage level to the chip through the second power rail. The power control device includes a comparison unit, a control unit, and a switch unit. The comparison unit electrically connects to the first power rail and the second power rail, respectively, and generates a comparing signal according to a reference signal, the first voltage level and the second voltage level. The control unit electrically connects to the comparison unit for receiving the comparing signal and generates a control signal based on the comparing signal. The switch unit electrically connects to the control unit, and is turned on/off based on the control signal so as to connect/disconnect the first power rail and the second power rail.

In addition, the invention also discloses a mainboard, which includes a chip, a first power rail, a second power rail, a comparison unit, a control unit, and a switch unit. The first power rail provides a first voltage level to the chip, and the second power rail provides a second voltage level to the chip. The comparison unit electrically connects to the first power rail and the second power rail, respectively, and generates a comparing signal according to a reference signal, the first voltage level and the second voltage level. The control unit electrically connects to the comparison unit for receiving the comparing signal and generates a control signal based on the comparing signal. The switch unit electrically connects to the control unit, and is turned on/off based on the control signal so as to connect/disconnect the first power rail and the second power rail.

As mentioned above, the invention employs a comparison unit, a control unit and a switch unit to control the connection/disconnection of the first and second power rails. Thus, the time delays that the first and second power rails reach the regulating voltage states can be shorten and it is non-obvious. Accordingly, the chip can operate normally.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
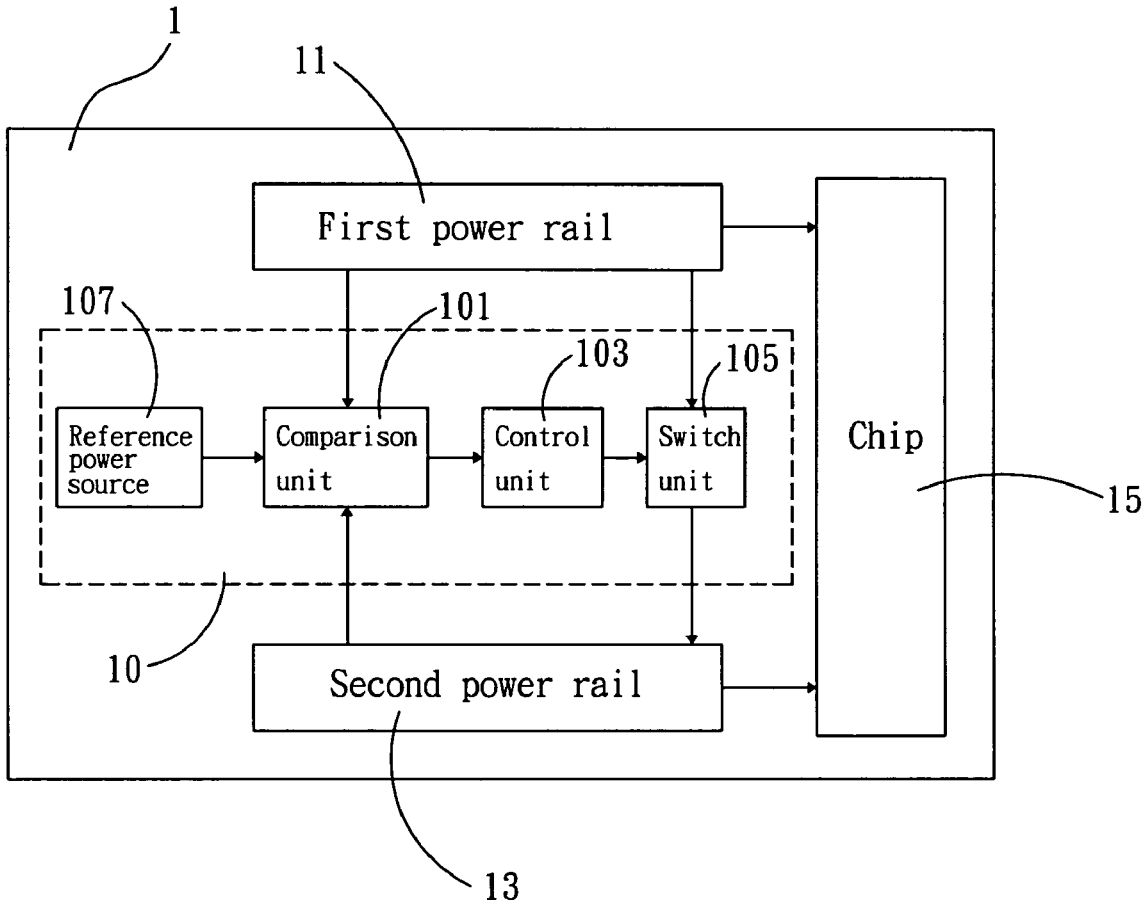
FIG. 1A is a block diagram of a mainboard and a power control device thereof according to a preferred embodiment of the invention.
Figure 1B:
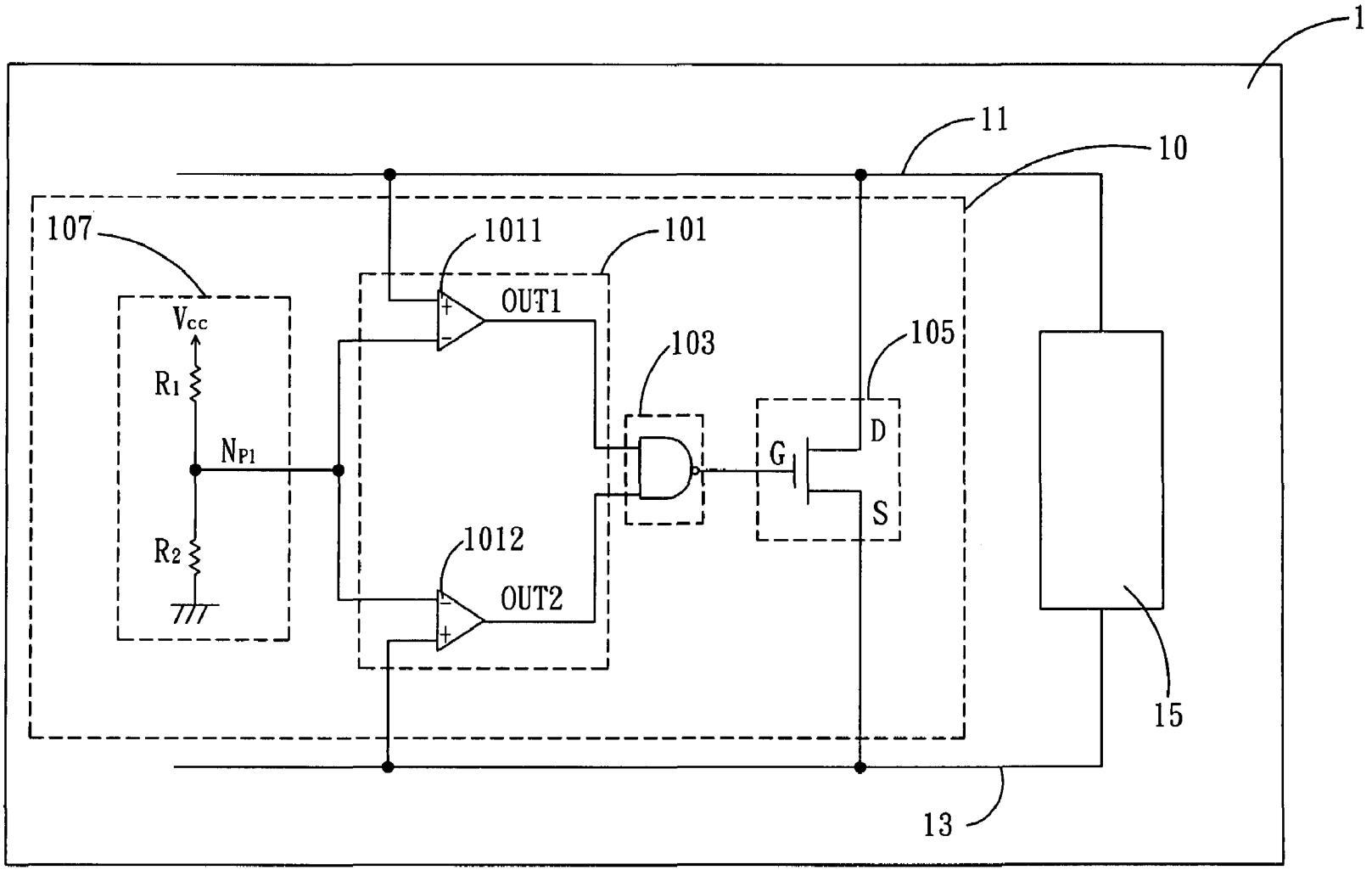
FIGS. 1B and 1C are circuit diagrams of the mainboard and power control device thereof according to the preferred embodiment of the invention.

With reference to FIG. 1A and FIG. 1B, which respectively show a block diagram and a circuit diagram of a mainboard and a power control device according to a preferred embodiment of the invention, a mainboard 1 includes a power control device 10 (shown as the dotted block). In this embodiment, the mainboard 1 can be a computer main board.

The mainboard 1 includes a power control device 10, a first power rail 11, a second power rail 13, and a chip 15.

The chip 15, such as a south bridge chip or a north bridge chip, is a semiconductor chip disposed on the mainboard 1. There are many digital logics (not shown) are configured inside the chip 15 for executing data calculation and data processing. The digital logics of the chip 15 may be driven by voltage levels of 3.3 volts and 2.5 volts, respectively. In other words, the chip 15 may need voltage levels of 3.3 volts and 2.5 volts at the same time. To be noted, this embodiment takes the voltage levels of 3.3 volts and 2.5 volts for example, but the usable voltage levels should not be limited. In practice, the chip 15 can have different voltage levels according to the required bias corresponding to the digital logics.

The first power rail 11 is a 3.3-volt power rail of the mainboard, and the second power rail 13 is a 2.5-volt power rail of the mainboard. In this embodiment, the first power rail 11 and the second power rail 13 are the power line layout of the mainboard, and are respectively connected to the chip 15 for providing a first voltage level (3.3 volts) and a second voltage level (2.5 volts). The first and second voltage levels are supplied for the operations of the chip 15. In general, the first power rail 11 and the second power rail 13 of the mainboard 1 have different time delays to reach the regulating voltage states (3.3 volts and 2.5 volts). That is, there is a different between the time delays that the two power rails reach the regulating voltage states.

The power control device 10 includes a comparison unit 101, a control unit 103, a switch unit 105 and a reference power source 107. The comparison unit 101 electrically connects to the first power rail 11 for receiving the first voltage level and the second power rail 13 for receiving the second voltage level, respectively. In the current embodiment, the comparison unit 101 includes a first comparator 1011 and a second comparator 1012. The first comparator 1011 and the second comparator 1012 both have two inputs and one output (the output OUT1 or the output OUT2). The two inputs of each of the first comparator 1011 and the second comparator 1012 include a positive input (referring to the mark "+" shown in FIG. 1B) and a negative input (referring to the mark "−" shown in FIG. 1B).

As mentioned above, the positive input of the first comparator 1011 electrically connects to the first power rail 11, and the positive input of the second comparator 1012 electrically connects to the second power rail 13. In addition, the negative inputs of the first comparator 1011 and the second comparator 1012 electrically connect to the reference power source 107. The first comparator 1011 generates a first comparing signal (OUT1) according to a reference signal provided by the reference power source 107 and the first voltage level. Similarly, the second comparator 1012 generates a second comparing signal (OUT2) according to the reference signal provided by the reference power source 107 and the second voltage level.

The control unit 103 electrically connects to the comparison unit 101 for receiving the first comparing signal (OUT1) and the second comparing signal (OUT2), and then generates a control signal based on the first and second comparing signals. In the present embodiment, the control unit 103 is an NAND gate, which has two inputs connecting to the output OUT1 of the first comparator 1011 and the output OUT2 of the second comparator 1012 respectively. Thus, the control unit 103 can receive the first comparing signal and the second comparing signal. In this case, the control unit 103 generates a control signal according to the first comparing signal and the second comparing signal.

In the embodiment, the switch unit 105 is an NMOS switch component, which has a gate G, a source S and a drain D. The gate G electrically connects to the control unit 103, the drain D electrically connects to the first power rail 11, and the source S electrically connects to the second power rail 13. The switch unit 105 is turned on/off based on the control signal. When the switch is turned on, the circuit between the first power rail 11 and the second power rail 13 is a short circuit. In contrary, when the switch is turned off, the circuit between the first power rail 11 and the second power rail 13 is an open circuit. Besides, those skilled in the art should know that the switch unit could be a PMOS switch component (not shown).

In this embodiment, the reference power source 107 is a DC power source Vcc of the mainboard 1. The reference power source 107 includes a first resistor $R_1$ and a second resistor $R_2$ for voltage dividing. Thus, the node $N_{P1}$ can provide the desired reference voltage level. Herein, the reference voltage level is assumed to be 2.25 volts. The negative inputs of the first comparator 1011 and the second comparator 1012 electrically connect to the node $N_{P1}$. To be noted, the user can adjust the ratio of the first resistor $R_1$ to the second resistor $R_2$ so as to obtain the desired reference voltage level. To achieve this, the resistances of the first resistor $R_1$ and the second resistor $R_2$ must be optional based on the real demands of the user.

The operation of the power control device 10 according to this embodiment is described herein below. Firstly, when the chip 15 disposed on the mainboard 1 is to be driven, the first power rail 11 and the second power rail 13 are stared to be charged so as to provide a first voltage level and a second voltage level to the chip 15 through the power rails. At this timing, the voltage levels of the first power rail 11 and the second power rail 13 do not reach the regulating voltage states (3.3 volts and 2.5 volts) yet, and do not reach the reference voltage level (2.25 volts) yet. The positive input of the first comparator 1011 receives the first voltage level, and the negative input of the first comparator 1011 receives the reference voltage level (2.25 volts). After that, the first comparator 1011 starts to compare the first voltage level and the reference voltage level, so as to generate a first comparing signal, which is then transferred to the control unit 103.

Besides, the positive input of the second comparator 1012 receives the second voltage level, and the negative input of the second comparator 1012 receives the reference voltage level (2.25 volts). After that, the second comparator 1012 starts to compare the second voltage level and the reference voltage level, so as to generate a second comparing signal, which is then transferred to the control unit 103.

At this timing, the first voltage level and the second voltage level do not reach the reference voltage level (2.25 volts) yet. Thus, the first comparing signal and the second comparing signal are both at low voltage level, and the control signal generated by the control unit 103 is accordingly at high voltage level. Accordingly, the control unit 103 controls the switch unit 105 to be turned on, so that the first power rail 11 and the second power rail 13 are connected. As a result, the first power rail 11 and the second power rail 13 have the same voltage levels.

At another timing, if the first voltage level of the first power rail 11 reaches the reference voltage level (2.25 volts) first, and the second voltage level of the second power rail 13 does not reach the reference voltage level (2.25 volts) yet, the first comparing signal is at high voltage level, and the second comparing signal is at low voltage level. Thus, the control signal generated by the control unit 103 is accordingly at high voltage level. Accordingly, the control unit 103 controls the switch unit 105 to be turned on, so that the first power rail 11 and the second power rail 13 are connected. As a result, the first power rail 11 and the second power rail 13 have the same voltage levels. Alternatively, at another timing, if the second voltage level of the second power rail 13 reaches the reference voltage level (2.25 volts) first, and the first voltage level of the first power rail 11 does not reach the reference voltage level (2.25 volts) yet, the second comparing signal is at high voltage level, and the first comparing signal is at low voltage level. Thus, the control signal generated by the control unit 103 is accordingly at high voltage level. Accordingly, the control unit 103 controls the switch unit 105 to be turned on, so that the first power rail 11 and the second power rail 13 are connected. As a result, the first power rail 11 and the second power rail 13 have the same voltage levels. Based on this mechanism, the time delays that the first and second voltage levels reach the regulating voltage states (3.3 volts and 2.5 volts) can be shorten and be non-obvious.

At still another timing, when the first voltage level and the second voltage level both reach the reference voltage level (2.25 volts), the first comparator 1011 compares the first voltage level and the reference voltage level (2.25 volts) and then generates a first comparing signal of high voltage level, which is then transferred to the control unit 103, and the second comparator 1012 compares the second voltage level and the reference voltage level (2.25 volts) and then generates a second comparing signal of high voltage level, which is then also transferred to the control unit 103. The control unit 103 generates a control signal of low voltage level according to the first comparing signal and the second comparing signal. Accordingly, the control unit 103 outputs the control signal to turn off the switch unit 105, so that the first power rail 11 and the second power rail 13 are disconnected. At this moment, the first power rail 11 and the second power rail 13 respectively provide the first voltage level and the second voltage level to the chip 15. The provided first voltage level and second voltage level respectively reach the regulating voltage states (3.3 volts and 2.5 volts), and are used to drive the chip 15.

Figure 1C:
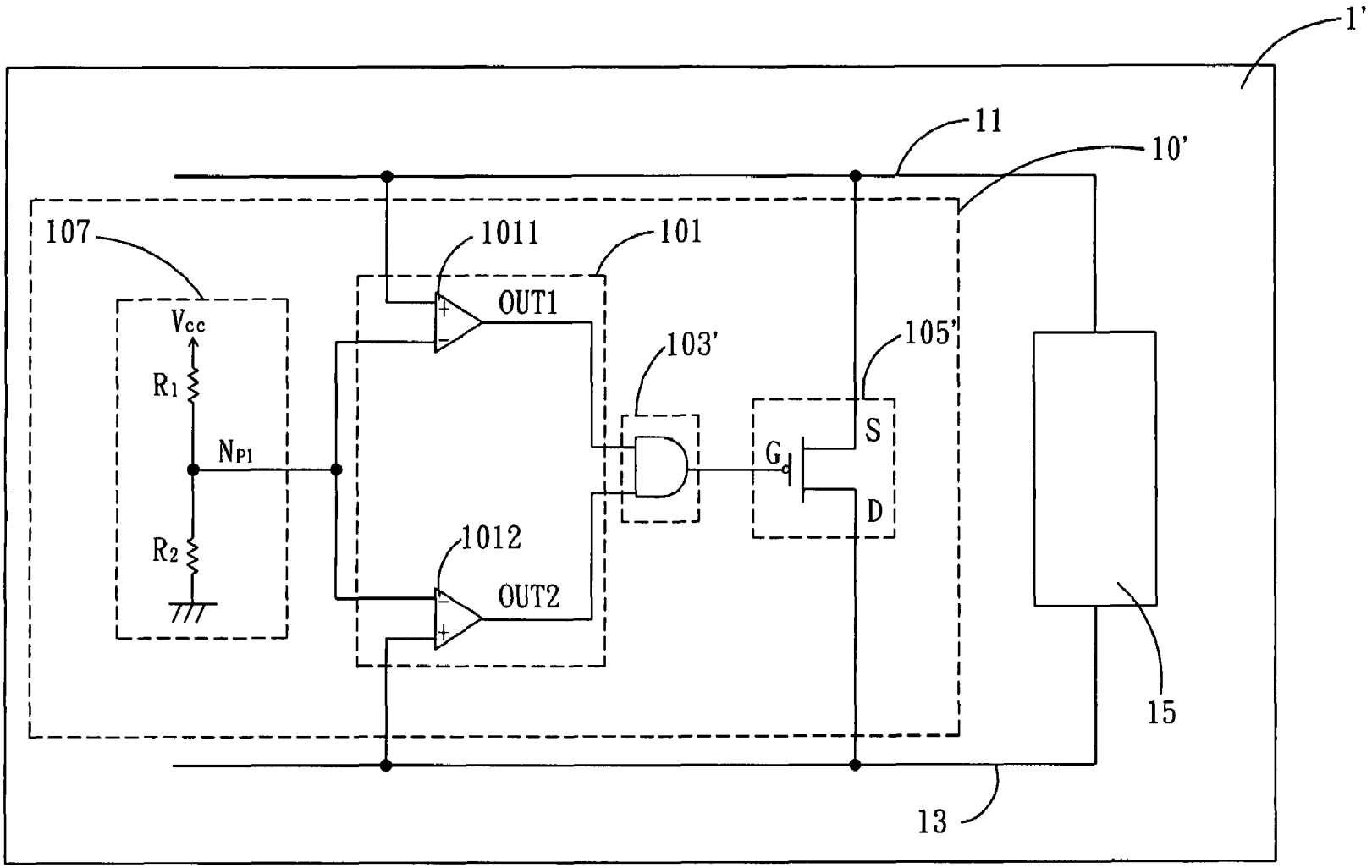

With reference to FIG. 1C, a mainboard 1' according to another embodiment of the invention includes a power control device 10', a first power rail 11, a second power rail 13, and a chip 15. In this embodiment, the power control device 10' includes a comparison unit 101, a control unit 103', a switch unit 105' and a reference power source 107. The control unit 103' is an AND logic gate, and the switch unit 105' is a PMOS switch component. To be noted, the other elements of this embodiment are similar to those with the same reference numbers of the previous embodiment as shown in FIG. 1B, so the detailed descriptions are omitted for concise purpose.

At the timing when the first voltage level and the second voltage level do not reach the reference voltage level (2.25 volts) yet, the first comparing signal and the second comparing signal are both at low voltage level, and the control signal generated by the control unit 103' is accordingly at low voltage level. Accordingly, the control unit 103' controls the switch unit 105' to be turned on, so that the first power rail 11 and the second power rail 13 are connected. As a result, the first power rail 11 and the second power rail 13 have the same voltage levels.

At another timing, if the first voltage level of the first power rail 11 reaches the reference voltage level (2.25 volts) first, and the second voltage level of the second power rail 13 does not reach the reference voltage level (2.25 volts) yet, the first comparing signal is at high voltage level, and the second comparing signal is at low voltage level. Thus, the control signal generated by the control unit 103' is accordingly at low voltage level. Accordingly, the control unit 103' controls the switch unit 105' to be turned on, so that the first power rail 11 and the second power rail 13 are connected. As a result, the first power rail 11 and the second power rail 13 have the same voltage levels. Alternatively, at another timing, if the second voltage level of the second power rail 13 reaches the reference voltage level (2.25 volts) first, and the first voltage level of the first power rail 11 does not reach the reference voltage level (2.25 volts) yet, the second comparing signal is at high voltage level, and the first comparing signal is at low voltage level. Thus, the control signal generated by the control unit 103' is accordingly at low voltage level. Accordingly, the control unit 103' controls the switch unit 105' to be turned on, so that the first power rail 11 and the second power rail 13 are connected. As a result, the first power rail 11 and the second power rail 13 have the same voltage levels. Based on this mechanism, the time delays that the first and second voltage levels reach the regulating voltage states (3.3 volts and 2.5 volts) can be shorten and be non-obvious.

At still another timing, when the first voltage level and the second voltage level both reach the reference voltage level (2.25 volts), the first comparator 1011 compares the first voltage level and the reference voltage level (2.25 volts) and then generates a first comparing signal of high voltage level, which is then transferred to the control unit 103', and the second comparator 1012 compares the second voltage level and the reference voltage level (2.25 volts) and then generates a second comparing signal of high voltage level, which is then also transferred to the control unit 103'. The control unit 103' generates a control signal of high voltage level according to the first comparing signal and the second comparing signal. Accordingly, the control unit 103' outputs the control signal to turn off the switch unit 105', so that the first power rail 11 and the second power rail 13 are disconnected. At this moment, the first power rail 11 and the second power rail 13 respectively provide the first voltage level and the second voltage level to the chip 15. The provided first voltage level and second voltage level respectively reach the regulating voltage states (3.3 volts and 2.5 volts), and are used to drive the chip 15.

As mentioned above, the switch unit 105 or 105' electrically connects to the first power rail 11 and the second power rail 13. Therefore, the first power rail 11 and the second power rail 13 are shorted before they do not reach the reference voltage level (2.25 volts). This can make the first power rail 11 and the second power rail 13 reach the reference voltage level (2.25 volts) at the same time to avoid the abnormal operations of the digital logics inside the chip 15.

Figure 2:
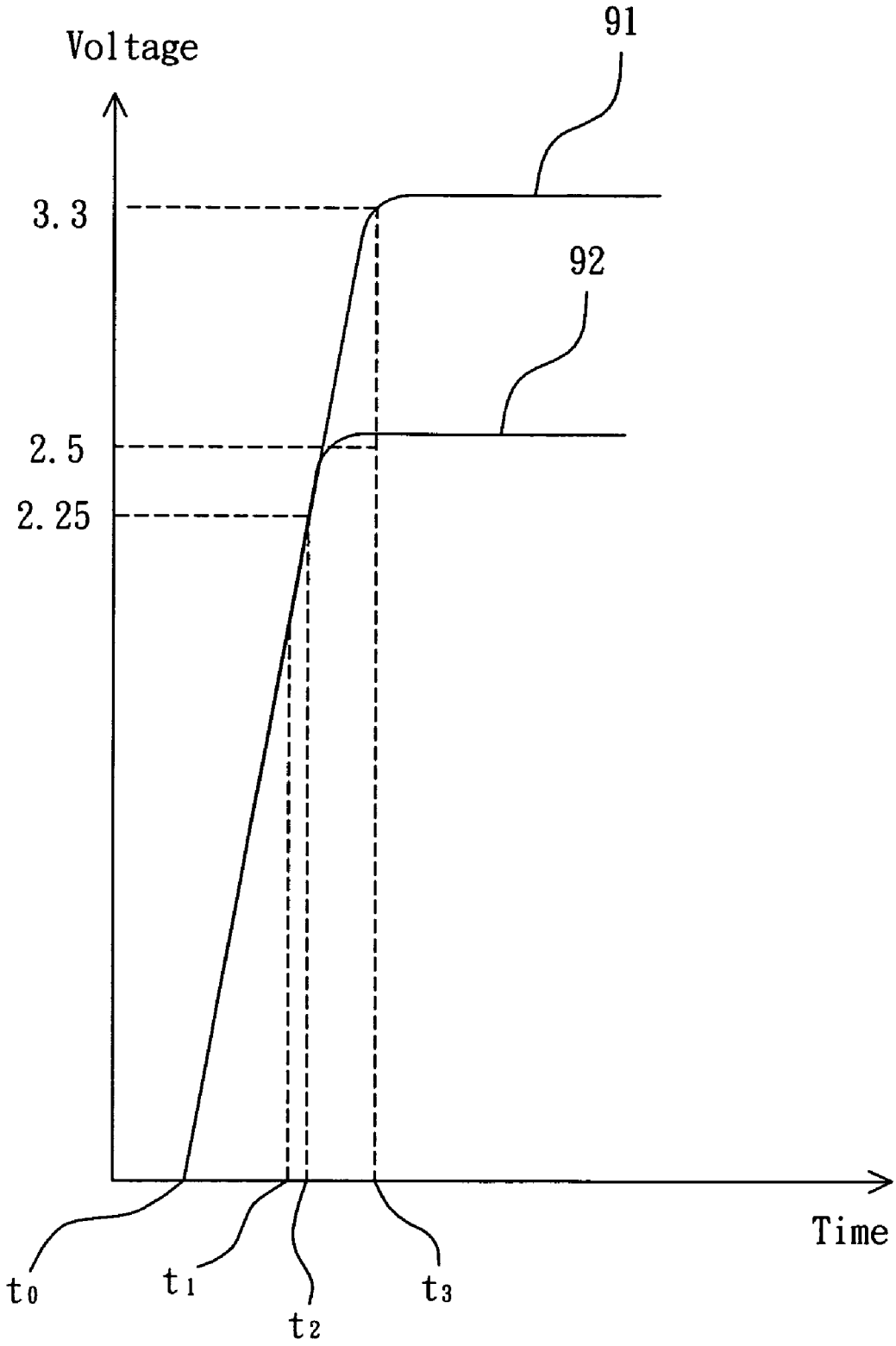
FIG. 2 is a timing diagram of a first power rail and a second power rail when the power control device as shown in FIG. 1B works.

Please refer to FIG. 2. FIG. 2 shows the timing diagram of the first power rail 11 and the second power rail 13 when the power control device 10 shown in FIG. 1B works. Herein, the lateral axis is time, and the longitudinal axis is voltage. The continuous curves respectively show the first voltage level 91 of the first power rail and the second voltage level 92 of the second power rail. Hereinafter, the operation of the mainboard and power control device thereof shown in FIG. 1B will be described with reference to the timing diagram of FIG. 2.

At first, during the period between $t_0$ and $t_1$, the first voltage level 91 and the second voltage level 92 are applied to the chip 15 for driving the chip 15 of the mainboard 1. During this period, the first voltage level 91 and the second voltage level 92 do not reach the reference voltage level (2.25 volts). The first comparator 1011 compares the first voltage level 91 and the reference voltage level (2.25 volts) to generate the first comparing signal. In addition, the second comparator 1012 compares the second voltage level 92 and the reference voltage level (2.25 volts) to generate the second comparing signal. In this condition, the control unit 103 controls the switch unit 105 to be turned on, so that the first power rail 11 and the second power rail 13 are connected. In this case, the first voltage level and the second voltage level are the same.

At $t_1$, assuming that the second voltage level 92 applied to the second comparator 1012 reaches the reference voltage level (2.25 volts) first, and the first voltage level 91 applied to the first comparator 1011 does not reach the reference voltage level (2.25 volts) yet, the second comparing signal is at high voltage level, and the first comparing signal is at low voltage level. Thus, the control signal generated by the control unit 103 is accordingly at high voltage level. Accordingly, the control unit 103 generates a control signal according to the first comparing signal and the second comparing signal, so as to control the switch unit 105 to be turned on. Accordingly, the first power rail 11 and the second power rail 13 are connected by the switch unit 105. In this case, the second voltage level 92 and the first voltage level 91 coupled to the switch unit 105 may have the same voltage level. As a result, the first voltage level 91 and the second voltage level 92 can be adjusted to approach 2.25 volts at $t_1$.

At $t_2$, when the first voltage level 91 and the second voltage level 92 both reach the reference voltage level (2.25 volts), the control unit 103 generates the control signal of low voltage level for controlling the switch unit 105 to be turned off. Accordingly, the first power rail 11 and the second power rail 13 are disconnected. In this case, the second voltage level 92 and the first voltage level 91 present different voltage levels. As a result, the first voltage level 91 and the second voltage level 92 can reach the regulating voltage states (3.3 volts and 2.5 volts) at $t_1$, respectively.

In summary, the invention utilizes the connection/disconnection of the first power rail 11 and the second power rail 13 to control the timings that the first voltage level 91 and the second voltage level 92 reach the regulating voltage states (3.3 volts and 2.5 volts). Thus, the time delays that the first voltage level 91 and the second voltage level 92 reach the regulating voltage states can be shorten. Accordingly, the chip 15 can operate normally.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A power control device, which is cooperated with a first power rail and a second power rail, wherein the first power rail and the second power rail are respectively coupled to a chip for providing a first voltage level to the chip through the first power rail and a second voltage level to the chip through the second power rail, the power control device comprising:

a comparison unit, which electrically connects to the first power rail and the second power rail, respectively, and generates a comparing signal according to a reference voltage level, the first voltage level and the second voltage level;

a control unit, which electrically connects to the comparison unit for receiving the comparing signal and generates a control signal based on the comparing signal; and a switch unit, which electrically connects to the control unit, and is turned on/off based on the control signal so as to connect/disconnect the first power rail and the second power rail, wherein the first voltage level equals to the second voltage level when both the first voltage level and the second voltage level do not reach the reference voltage level.

2. The power control device of claim 1, further comprising:

a reference power source, which provides the reference voltage level, wherein the reference voltage, the first voltage level and the second voltage level are higher than zero.

3. The power control device of claim 1, wherein the comparison unit comprises a first comparator connecting to the first power rail and a second comparator connecting to the second power rail.

4. The power control device of claim 1, wherein the control unit is an NAND logic gate.

5. The power control device of claim 1, wherein the switch unit is an NMOS switch component.

6. The power control device of claim 1, wherein the switch unit is a PMOS switch component.

7. A mainboard, comprising:

a chip;

a first power rail, which provides a first voltage level to the chip;

a second power rail, which provides a second voltage level to the chip;

a comparison unit, which electrically connects to the first power rail and the second power rail, respectively, and generates a comparing signal according to a reference voltage level, the first voltage level and the second voltage level;

a control unit, which electrically connects to the comparison unit for receiving the comparing signal and generates a control signal based on the comparing signal; and a switch unit, which electrically connects to the control unit, and is turned on/off based on the control signal so as to connect/disconnect the first power rail and the second power rail, wherein the first voltage level equals to the second voltage level when both the first voltage level and the second voltage level do not reach the reference voltage level.

8. The mainboard of claim 7, further comprising:

a reference power source, which provides the reference voltage level.

9. The mainboard of claim 8, wherein the first voltage level and the second voltage level are higher than zero.

10. The mainboard of claim 7, wherein the comparison unit comprises a first comparator connecting to the first power rail and a second comparator connecting to the second power rail.

11. The mainboard of claim 7, wherein the control unit is an NAND logic gate.

12. The mainboard of claim 7, wherein the switch unit is an NMOS switch component.

13. The mainboard of claim 7, wherein the switch unit is a PMOS switch component.

14. An apparatus coupled between a first power rail and a second power rail for power controlling, wherein the first power rail and the second power rail also electrically coupled to a chip for providing a first voltage level and a second voltage level respectively, comprising:

a switch unit, which receives a control signal and is turned on/off based on the control signal so as to connect/disconnect the first power rail, and the second power rail wherein the first voltage level equals to the second voltage level when both the first voltage level and the second voltage level do not reach a reference voltage level.

15. The apparatus according to claim 14, further comprising:

a control unit for receiving a comparing signal and generating the control signal based on the comparing signal.

16. The apparatus according to claim 15, further comprising:

a comparison unit, which electrically coupled to the first power rail and the second power rail, respectively, and generates the comparing signal according to the reference voltage level, the first voltage level and the second voltage level.

17. The apparatus according to claim 16, further comprising:

a reference power source for providing the reference voltage level, wherein the reference voltage level, the first voltage level and the second voltage level are higher than zero.

18. The apparatus according to claim 16, wherein the comparison unit comprises a first comparator connecting to the first power rail and a second comparator connecting to the second power rail.

19. The apparatus according to claim 15, wherein the control unit is an NAND logic gate and the switch unit is an NMOS switch component.

20. The apparatus according to claim 15, wherein the control unit is an AND logic gate and the switch unit is an PMOS switch component.

* * * * *